US008966784B2

(12) United States Patent
Völkel et al.

(10) Patent No.: US 8,966,784 B2
(45) Date of Patent: Mar. 3, 2015

(54) FRAGRANCE DISPENSER SYSTEM FOR USE IN A DRYER

(75) Inventors: Theodor Völkel, Erkrath (DE); Hans Bouten, Geldern (DE); Dietmar Schroöter, Düsseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 514 days.

(21) Appl. No.: 13/247,643

(22) Filed: Sep. 28, 2011

(65) Prior Publication Data

US 2012/0017462 A1 Jan. 26, 2012

Related U.S. Application Data

(63) Continuation of application No. PCT/EP2010/053534, filed on Mar. 18, 2010.

(30) Foreign Application Priority Data

Mar. 31, 2009 (DE) ..... 10 2009 002 016

(51) Int. Cl.

| | |
|---|---|
| ***F26B 5/00*** | (2006.01) |
| ***C11D 17/04*** | (2006.01) |
| ***C11D 3/50*** | (2006.01) |
| ***D06F 58/20*** | (2006.01) |

(52) U.S. Cl.

CPC ..... *C11D 17/047* (2013.01); *C11D 3/505* (2013.01); *D06F 58/203* (2013.01)

USPC ..... 34/389

(58) Field of Classification Search

CPC ..... F26B 5/00; F26B 5/005; F26B 9/00; F26B 21/00; F26B 21/02; A47L 9/12; B60S 3/002; A62C 33/02; D06F 58/00; D06F 58/20

USPC ..... 34/389, 90

See application file for complete search history.

(56) References Cited

U.S. PATENT DOCUMENTS

| | | | | |
|---|---|---|---|---|
| 2,941,309 | A * | 6/1960 | Cobb | 34/60 |
| 3,706,140 | A * | 12/1972 | Brillaud et al. | 34/60 |
| 4,014,105 | A * | 3/1977 | Furgal et al. | 34/389 |
| 4,706,802 | A | 11/1987 | Leigh et al. | |
| 4,839,076 | A * | 6/1989 | Willman et al. | 510/297 |
| 4,920,662 | A * | 5/1990 | Seeburger | 34/60 |
| 5,246,611 | A * | 9/1993 | Trinh | 510/515 |
| 5,668,097 | A * | 9/1997 | Trinh et al. | 510/293 |
| 5,966,831 | A * | 10/1999 | Anderson | 34/60 |
| 6,029,900 | A * | 2/2000 | Quinones | 239/47 |
| 6,174,577 | B1 * | 1/2001 | Vitorino | 428/36.5 |
| 7,012,053 | B1 * | 3/2006 | Barnabas et al. | 510/287 |
| 7,681,328 | B2 * | 3/2010 | DuVal et al. | 34/597 |
| 8,205,351 | B2 * | 6/2012 | Howe et al. | 34/60 |
| 2008/0209756 | A1 * | 9/2008 | Burgess et al. | 34/389 |
| 2009/0282694 | A1 * | 11/2009 | Magennis et al. | 34/337 |
| 2010/0132214 | A1 * | 6/2010 | DuVal et al. | 34/389 |
| 2012/0017462 | A1 * | 1/2012 | Volkel et al. | 34/389 |
| 2012/0137535 | A1 * | 6/2012 | Sieben et al. | 34/95 |

FOREIGN PATENT DOCUMENTS

| | | | |
|---|---|---|---|
| WO | WO 2004/020004 | A1 | 3/2004 |
| WO | WO 2007/115872 | A1 | 10/2007 |
| WO | WO 2009135904 | A1 * | 11/2009 |

OTHER PUBLICATIONS

PCT International Search Report (PCT/EP2010/053534) dated Jun. 21, 2010.

* cited by examiner

*Primary Examiner* — Steve M Gravini

(74) *Attorney, Agent, or Firm* — David K. Benson

(57) ABSTRACT

A fragrance dispenser system for use in a dryer includes a scented composition that is located in a dispenser device having perforations in the wall. The scented composition has a water-soluble, particulate carrier and a scented substance.

7 Claims, No Drawings

FRAGRANCE DISPENSER SYSTEM FOR USE IN A DRYER

CROSS-REFERENCES TO RELATED APPLICATIONS

This application is a continuation of Application No. PCT/EP2010/053534, filed on Mar. 18, 2010, which claims priority to DE 10 2009 002 016.0 filed on Mar. 31, 2009, both of which are incorporated herein by reference.

FIELD OF THE INVENTION

The present invention generally relates to a system of scented composition and dispensing device for use in a dryer as well as method for scenting textiles.

BACKGROUND OF THE INVENTION

In addition to being cleansed of spots, soil or unpleasant odors, it is important for many users that textiles have a pleasant fragrance after being washed and/or dried. To this end, the textiles are often treated with a softener in a subsequent rinsing operation after the actual washing and cleaning process.

Most softeners on the market are aqueous formulations having as the main active ingredient a cationic fabric softening compound, which has one or two long chain alkyl groups in a molecule. The very popular cationic textile softener compounds comprise so-called ester quats, for example.

For towels, functional textiles, and many other cases, the use of a softener is unwanted or even unsuitable. Breathability may be impaired in breathable functional textiles, for example, when using traditional softeners with ester quats. Many consumers do not use softeners with towels because the ester quats contained in them reduce the absorbency and water uptake capacity of the towels. Consumers would nevertheless like to impart a pleasant fragrance to these items as well.

EP 2001986 A1, for example, discloses a solid fabric softening composition containing a scent and used in the main wash cycle of a washing machine.

Furthermore, more consumers are using dryers to dry textiles. Due to the elevated temperatures associated with drying in a dryer, a large portion of the fragrance imparted in washing the textiles is often lost.

Accordingly, it is desirable to provide a system, for use in a dryer, which will impart a fragrance to the textiles treated in the dryer.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A system for perfuming textiles is provided. The system comprises for a scented composition and a dispensing device for use in the dryer. The scented composition comprises a water-soluble, particulate carrier and a scent, and the dispensing device has a cavity formed by one or more walls in the interior of the device to receive the scented composition, a closable opening for filling the cavity and perforations in the wall(s).

A method is provided for perfuming textiles, wherein a scented composition, comprising a water-soluble, particulate carrier and a scent is filled into a cavity formed by one or more perforated walls in a dispensing device. The filled dispensing device is closed, placed in a dryer filled with textiles, and the textiles are subjected to a drying and/or freshening process.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A system for perfuming a textile includes a scented composition and a dispensing device for use in a dryer. The scented composition includes a water-soluble particulate carrier and a scent, and the dispensing device includes a cavity formed by one or more walls in the interior of the device to receive the scented composition, and also includes a closable opening for filling the cavity. The wall(s) defining the cavity have perforations therein.

It has surprisingly been found that when using such a scented composition in the dryer, a definite intensification of the fragrance intensity in the treated textiles can be achieved.

It is preferable that the water-soluble carrier is selected from the group consisting of inorganic alkali metal salts, organic alkali metal salts, inorganic alkaline earth metal salts, organic alkaline earth metal salts, organic acids, carbohydrates, silicates, urea and mixture thereof.

These materials are not only inexpensive but are also odor neutral in most cases.

It is preferable in particular for the water-soluble carrier to be selected from the group consisting of carbohydrates, urea and mixtures thereof.

In an especially preferred embodiment the water-soluble carrier is a carbohydrate selected from a group consisting of dextrose, fructose, galactose isoglucose, glucose, sucrose, raffinose, isomalt and mixtures thereof.

Scented compositions with these carrier materials can be disposed of with the normal household garbage with no problem after being used in the dryer.

It may be preferable for the scented composition to also contain a water-soluble polymer.

The water-soluble polymer may be present, for example, in the form of a sheathing in the scented composition and thus improve the mechanical sturdiness fo the scented composition in particular for use in the dryer.

In an alternative embodiment, the scented composition has at least a partial sheathing of a saccharide, wherein the saccharide is selected from the group of monosaccharides, oligosaccharides and mixtures thereof.

Furthermore, it may be preferable for the scented composition to also contain a powdered textile and/or skin care compound.

The powdered textile and/or skin care compound may dissolve while the system is being used in a dryer and pass through the perforations in the walls of the dispensing device onto the textiles.

To prevent direct contact of the scented composition with the textiles, it is preferable for the diameter of the wall perforations to correspond maximally to half of the particle diameter of the water-soluble carrier.

The invention also relates to the use of a scented composition comprising a water-soluble particulate carrier and a scent in a dispensing device, wherein the dispensing device has a cavity formed by one or more walls in the interior of the device to receive the scented composition, a closable opening for filling the cavity and perforations in the wall(s).

Furthermore, the invention also relates to a method for scenting textiles in which (a) a scented composition comprising a water-soluble particulate carrier and a scent is filled into a cavity in a dispensing device formed by one or more perforated walls, (b) the filled dispensing device is closed, (c) the filled dispensing device is placed in a dryer filled with textiles and (d) the textiles are subjected to a drying and/or freshening process.

The invention will be explained in greater detail below on the basis of examples, among other things.

The system for use in a dryer includes a scented composition and a dispensing device.

The scented composition contains a water-soluble particulate carrier and a scent.

The water-soluble particulate carrier is an essential component of the scented composition. It preferably comprises inorganic alkali metal salts such as, for example, sodium chloride, potassium chloride, sodium sulfate, sodium carbonate, potassium sulfate, potassium carbonate, sodium bicarbonate, potassium bicarbonate or mixtures thereof, organic alkali metal salts, for example, sodium acetate, potassium acetate, sodium citrate, sodium tartrate or potassium sodium tartrate, inorganic alkaline earth metals salts, for example, calcium fluoride, magnesium chloride or magnesium sulfate, organic alkaline earth metal salt, for example, calcium lactate, carbohydrates, organic acids, for example, citric acid or tartaric acid, silicates, for example, water glass, sodium silicate or potassium silicate, urea and mixtures thereof. The water-soluble carrier may comprise in particular a carbohydrate and/or urea. The carbohydrate is selected, for example, from the group consisting of dextrose, fructose, galactose, isoglucose, glucose, sucrose, raffinose, isomalt and mixtures thereof. The carbohydrate used may be in particular candy sugar, rock sugar or white sugar.

These materials as carriers in scented compositions have the advantage that the scented composition can be disposed of with no problem in the normal household garbage after being used.

It is preferable for the water-soluble particulate carriers to have particle sizes in the range of 0.1 to 10 mm, in particular 0.8 to 5 mm and especially preferably 1 to 3 mm. The amount of water-soluble particulate carrier is preferably 50 to 99 wt %, more preferably 75 to 95 wt %, based on the total scented composition.

Another essential component of the scented composition is the scent. A scent contains individual fragrance compounds, for example, the synthetic products of such types as esters, ethers, aldehydes, ketones, alcohols and hydrocarbons. However, mixtures of different fragrance compounds which together create a pleasant fragrance note are preferred. Such scent oils may also contain natural fragrance substance mixtures such as those accessible from vegetable sources.

The amount of scent in the scented composition is preferably between 0.1 and 15 wt %, in particular preferably between 0.5 and 10 wt % and most especially preferably between 1 and 7 wt %.

In a preferred embodiment the scent composition additionally contains a water-soluble polymer. Suitable water-soluble polymers preferably have a melting point or softening point in the range of 48° C. to 300° C. and may comprise polyalkylene glycols, in particular polyethylene glycols, polyethylene terephthalates and/or polyvinyl alcohols.

The melting point refers to the transition from a solid state to a liquid (free flowing) state. The softening describes the transition from a solid state to a rubbery to viscous melt. The melting point and the softening point may each be either a specific temperature or a small range within the range of 48° C. to 300° C.

Suitable polyalkylene glycols comprise in particular polyethylene glycols, which are liquid or solid polymers, depending on chain length. Beyond a molecular weight of 3000, the polyethylene glycols are solid substances and are brought on the market as flakes or powders. The hardness and melting range in crease with an increase in the molecular weight. Polyethylene glycols with an average molecular weight between 3000 and 12,000, more preferably with an average molecular weight between 4000 and 10,000 and in particular preferably with an average molecular weight between 6000 and 8000 are preferred for the present invention.

The water-soluble polymer may also contain a mixture of the aforementioned materials. However, it is preferable for the scented composition to comprise a polyalkylene glycol and in particular a polyethylene glycol as the water-soluble polymer.

It is preferable that the water-soluble polymer is applied in the form of a sheathing to the water-soluble particulate carrier. Furthermore, it is preferable that the scent is present in the sheathing.

In this way different scented compositions can be obtained easily and rapidly because only the composition of the sheathing need be altered.

In another preferred embodiment of the invention, the scented composition comprises at least partial sheathing of a saccharide, the saccharide being selected from the group of monosaccharides, oligosaccharides and mixtures thereof.

Monosaccharides are linear polyhydroxyaldehydes (aldoses) and/or polyhydroxyketones (ketoses) and preferably comprise pentoses ($C_5H_{10}O_5$) and hexoses ($C_6H_{12}O_6$). Suitable pentoses include, for example, zylose, lyxose, ribose and arabinose. Suitable hexoses comprise, for example, glucose, galactose or mannose.

Two to 10 monosaccharide molecules are combined in oligosaccharides to form larger molecules with the loss of water and thus include disaccharides, trisaccharides, etc. Suitable oligosaccharides include, for example, sucrose, lactose, maltose. The saccharide sucrose is especially preferred for use here.

The saccharide may also contain a mixture of the aforementioned mono- and oligosaccharides.

The scented composition may optionally contain additional ingredients.

To improve the aesthetic appearance of the scented composition, it may be pigmented using a suitable dye. Preferred dyes, the choice of which should not pose any problems for those skilled in the art, have a good stability in storage and are insensitive to the other ingredients as well as light and have no pronounced substantivity with respect to textile fibers so as not to stain the latter. If the scented composition has a sheathing of a water-soluble polymer, it is preferable for the pigment to be in the sheathing.

In addition, the scented composition may contain a filler, such as silica. The amount of filler may be between 0.1 and 10 wt % and is preferably 1 to 5 wt %.

The scented composition may also contain a pearlescent agent to increase the luster. Examples of suitable pearlescent agents include ethylene glycol mono- and distearate (for example, Cutina® AGS from Cognis) as well as PEG-3 distearate.

In addition, the scented composition may comprise a powdered textile and/or skin care compound. The powdered textile and/or skin care compounds may be applied to the textiles when the system is used in a dryer through the wall perforations.

A textile care compound in this context is understood to refer to any compound which imparts an advantageous effect to textile sheeting treated with it, for example, a fabric softening or antiwrinkle effect and/or reduces the harmful or negative effect which may occur in cleaning and/or conditioning and/or wearing, for example, fading, graying, etc.

A skin care compound is understood to be a compound or a mixture of compounds which are absorbed onto the textile when the textile compound in contact with the detergent and impart to the skin an advantage when the textile comes in contact with the skin in comparison with the textile not treated with the inventive detergent and cleaning agent. This advantage may comprise, for example, the transfer of the skin care compound from the textile to the skin, a lower transfer of water from the skin to the textile or a lower friction on the skin surface due to the textile.

The textile and/or skin care compound may be in particular a fabric softening compound. Especially preferred fabric softening compounds include fabric softening clays, cationic polymers or a mixture thereof.

For example, a smectite clay is a suitable fabric softening clay. Preferred smectite clays include beidellite clays, hectorite clays, laponite clays, montmorillonite clays, nontronite clays, saponite clays, sauconite clays and mixtures thereof. Montmorillonite clays are the preferred softening clays. Bentonites contain mainly montmorillonites and may be used as preferred source for the fabric softening clay.

Suitable bentonites include, for example, those distributed by the brand names Laundrosil® from the company Süd-Chemie or under the trademark Detercal from the company Laviosa. It is preferable for the scented composition to contain a powdered bentonite as the textile and/or skin care compound.

Suitable cationic polymers comprise in particular those published in the CTFA International Cosmetic Ingredient Dictionary, $4^{th}$ edition, J. M. Nikitakis et al., editors, by the Cosmetic, Toiletry and Fragrance Association 1991 and summarized under the umbrella term "polyquaternium."

The amount of textile and/or skin care compound in the scented composition, if present at all, is 0.1 to 15 wt % preferably between 2 and 12 wt %.

In a preferred embodiment the scented composition comprises a water-soluble particulate carrier, a water-soluble polymer, a powdered textile and/or skin care compound and a scent, wherein the water-soluble particulate carrier has at least partially a sheathing of the water-soluble polymer and the scent. The textile and/or skin care compound is either incorporated at least partially into the sheathing or the surface of the at least partially sheathed scent composition is coated with the powdered textile and/or skin care compound.

In an especially preferred embodiment the scented composition comprises a water-soluble particulate carrier, a water-soluble polymer, a powdered textile and/or skin care compound, a dye and a scent, wherein the water-soluble particulate carrier has at least partially a sheathing of the water-soluble polymer, dye and the scent. The textile and/or skin care compound is either at least partially incorporated into the sheathing or the surface of the at least partially sheathed scented composition is coated with the powdered textile and/or skin care compound.

With both embodiments it is preferable for the particulate carrier to be completely sheathed.

In another preferred embodiment the scented composition comprises a water-soluble particulate carrier, a monosaccharide and/or a oligosaccharide, a powdered textile and/or skin compound and a scent, wherein the scent is applied to the water-soluble particulate carrier, which has at least partial sheathing of the monosaccharide and/or disaccharide. The textile and/or skin care compound is either at least partially incorporated into the sheathing, or the surface of the at least partially sheathed scented composition is coated with the powdered textile and/or skin compound.

In another especially preferred embodiment, the scented composition comprises a water-soluble particulate carrier, a monosaccharide and/or oligosaccharide, a powdered textile and/or skin care compound, a dye and a scent, wherein the scent is applied to the water-soluble particulate carrier, which at least partially has a sheathing of the monosaccharide and/or disaccharide and the dye. The textile and/or skin care compound is either at least partially incorporated into the sheathing or the surface of the at least partially sheathed scented composition is coated with the powdered textile and/or skin care compound.

To prevent the formation of aggregates and/or lumps of the scented composition in the production, storage and/or use in the dryer, it may be preferable for the powdered textile and/or skin care agent to be present in mixture with the polysaccharide.

The polysaccharide may be selected from the group comprising glycogen, starch, chitin, callose, cellulose, dextran, tunicin, inulin, alginic acid, xanthan, gellan, guar, locust bean gum, carrageenan, derivatives of these compounds or mixtures of these compounds as well as their derivatives.

It is preferable for the polysaccharide to be a cellulose or a cellulose derivative selected from the group comprising methyl cellulose, ethyl cellulose, propyl cellulose, methyl ethyl cellulose, carboxymethyl cellulose, ethyl carboxymethyl cellulose, hydroxyethyl cellulose, hydroxypropyl cellulose, carboxymethyl hydroxyethyl cellulose, methyl hydroxyethyl cellulose, hydroxypropyl methyl cellulose, ethyl hydroxyethyl cellulose, methyl ethyl hydroxyethyl cellulose, quaternized cellulose, quaternized cellulose derivatives, amine-modified cellulose, amine-modified cellulose derivatives or mixtures of these compounds.

To produce a scented composition with a sheathing of water-soluble polymer, first the water-soluble polymer is melted and in a molten state mixed with the scent and the dye, if present. The resulting melt is applied to the particulate carrier in such a way that the latter is at least partially sheathed. Depending on the embodiment, the powdered textile and/or skin care compound or a mixture of a powdered textile and/or skin care compound and a polysaccharide is then incorporated into the sheathing while still molten, such that a large portion of the textile and/or skin care compound or the mixture of a powdered textile and/or skin care compound and a polysaccharide is at the surface of the sheathing or after solidification of the sheathing the surface of the resulting particle is coated with the powdered textile and/or skin care compound or the mixture of a powdered textile and/or skin care compound and a polysaccharide.

To prepare a scented composition with a sheathing of saccharide, first the particulate carrier is placed in a preheated mixer. Then the particulate carrier is treated with scent during the mixing operation and optionally with additional ingredients. Next a saccharide-containing melt is applied uniformly to the scented carrier and allowed to solidify. If the solid fragrance-imparting composition contains a powdered textile and/or skin care compound or a mixture of a powdered textile and/or skin care compound and a polysaccharide, then the sheathed scented carrier particles are either dusted with it as long as the saccharide-containing melt has not yet completely solidified or after solidification of the sheathing the surface of the resulting particle is coated with the powdered textile and/or skin care compound or a mixture of a powdered textile and/or skin care compound and a polysaccharide.

To vary the degree of hardness of the sheathing with saccharide, it may be advantageous to add additional ingredients such as water and/or binders to the saccharide melt. Suitable binders include anionic surfactants including soaps, nonionic surfactants, cationic surfactants, betaines, urea (derivatives), water glass, polyethylene glycols, glycerol, starches and mixtures thereof. The amount of water and/or binders is preferably max. 20 wt % based on the total sheathing material ("saccharide glaze"). The sheathing of saccharide may thus additionally contain water and/or binders. The use of binders in the sheathing leads to homogenization and stabilization of the saccharide glazes. The term "saccharide glaze" is understood within the context of this invention to refer to the sheathing of saccharide and optionally water and/or binders which has been applied to the scent-treated particulate carrier. Due to the presence of binders in the saccharide glaze, it is also less sensitive to mechanical stress and/or temperature influences.

In addition to the scented composition, the system also comprises a dispensing device. This dispensing device has a cavity formed by one or more walls in its interior to receive the scented composition. The dispensing device is preferably spherical and thus has only one wall. The dispensing device may alternatively also have a different shape, for example, oval or cylindrical. In the latter case the dispensing device has a plurality of walls, namely two opposing base walls and one side wall. One wall of the dispensing device has a closable opening for filling the cavity with the scented composition. After the use(s) in the dryer, the used composition is removed through the closable opening. The wall(s) has (have) perforations. These may be distributed regularly or irregularly in the wall(s). It is preferable for the diameter of the wall perforations to correspond to max. half of the particle diameter of the water-soluble carrier.

The dispensing device is formed by a thermally stable material. The dispensing device is preferably made of a thermal plastic polymer such as polyvinyl chloride (PVC), polyethylene of a high or low density (HDPE or LDPE), polyethylene terephthalate (PET), polypropylene (PP), polystyrene or blends thereof.

The closable opening is, for example, a screw lid, a stopper, a slide or a lockable valve.

The dispensing device is preferably transparent or translucent, so the user can easily ascertain the quantity of scented composition in the dispensing device and, when the system that has been filled once with the scented composition has been used several times, it is possible to ascertain the properties of the scented composition.

Exemplary Embodiments

Table 1 shows the compositions of two scented compositions E1 and E2 (all quantities are given in wt % active ingredient based on the total scented composition):

TABLE 1

| | E1 | E2 | E3 |
|---|---|---|---|
| Sucrose crystals (1-4 mm) | 69.99 | 69.99 | 69 |
| Bentonite (powder) | 10 | 9 | 10 |

TABLE 1-continued

| | E1 | E2 | E3 |
|---|---|---|---|
| Carboxymethyl cellulose sodium salt* | — | 1 | — |
| Scent | 5 | 5 | 1 |
| PEG 8000 | 15 | 15 | — |
| Saccharide-containing sheathing | — | — | 20 |
| Dye (blue) | 0.01 | 0.01 | — |

*The cellulose derivative was used in powder form.

Table 2 shows the composition of the saccharide-containing sheathing (all amounts are given in wt % active ingredient based on the composition).

TABLE 2

| | |
|---|---|
| Sucrose powder | 84.99 |
| $C_{12}$-$C_{18}$ ROH (7 EO) | 5 |
| Dye (blue) | 0.01 |
| Water | 10 |

Portions of 40 g of the scented compositions E1 through E3 were poured through an opening into a metering ball made of HDPE with a diameter of 10 cm, the wall of which had regularly distributed perforations each with a diameter of 200 to 800 μm. Next the metering ball was sealed using a screw lid and placed together with wet textiles in a dryer. After the end of the drying process, the dried textiles had an intense fragrance.

For comparing the fragrance intensity of the inventive system with the use of the scented composition in the wash cycle of a washing machine, terry cloth fabric was washed on the one hand with only 95 g of a solid commercially available detergent (reference 1) and on the other hand with 95 g of the same solid detergent and 40 g of the scented composition E1 in a washing machine (Miele Novotronic W 985) (reference 2) and then dried in a dryer (Kenmore model no. 417). Furthermore, terrycloth fabric was washed with 95 g of the same detergent and next dried with an inventive system containing 40 g of the scented composition E1 in a dryer. The fragrance intensity was determined next:

| Composition | Value |
|---|---|
| Reference 1 | 1.6 |
| Reference 2 | 2.2 |
| E1 | 3.7 |

Evaluation: 0=weak to 4=strong

Number of people performing an evaluation: 7

The results show clearly that a definite intensification of the fragrance of the dried textiles can be achieved by using an inventive system in a dryer.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A system for use in a dryer comprising:

a scented composition comprising:

a water-soluble particulate carrier selected from the group consisting of dextrose, fructose, galactose, isoglucose, glucose, sucrose, raffinose, isomalt, urea, and mixtures thereof, and a scent; and a dispensing device comprising:

a cavity defined by at least one wall, the cavity being adapted to receive the scented composition, a closable opening formed in the at least one wall for filling the cavity with the scented composition including the particulate carrier, and perforations in the at least one wall.

2. The system according to claim 1, wherein the scented composition additionally comprises a water-soluble polymer.

3. The system according to claim 1, wherein the scented composition further comprises at least a partial sheathing on the carrier, the sheathing comprising a saccharide selected from the group consisting of monosaccharides, oligosaccharides and mixtures thereof.

4. The system according to claim 1, wherein the scented composition further comprises a powdered textile-care compound and/or skin-care compound.

5. The system according to claim 1, wherein the diameter of the wall perforations corresponds maximally to half of the particle diameter of the water-soluble carrier.

6. A method for perfuming textiles, comprising:

(a) loading a scented composition, comprising a water-soluble, particulate carrier selected from the group consisting of dextrose, fructose, galactose, isoglucose, glucose, sucrose, raffinose, isomalt and mixtures thereof, and a scent, into a cavity formed by one or more perforated walls in a dispensing device;

(b) closing the filled dispensing device;

(c) placing the filled dispensing device in a dryer filled with textiles; and (d) subjecting the textiles to a freshening process in which the scent interacts with the textiles.

7. The method according to claim 6, wherein the freshening process is also a drying process for the textiles.

* * * * *

UNITED STATES PATENT AND TRADEMARK OFFICE

CERTIFICATE OF CORRECTION

PATENT NO. : 8,966,784 B2
APPLICATION NO. : 13/247643
DATED : March 3, 2015
INVENTOR(S) : Theodor Völkel, Hans Bouten and Dietmar Schröter It is certified that error appears in the above-identified patent and that said Letters Patent is hereby corrected as shown below:

On the title page, item 75 Inventor's Name, change from "Dietmar Schroöter" to
-- "Dietmar Schröter" --

Signed and Sealed this
Seventeenth Day of November, 2015

Michelle K. Lee

Michelle K. Lee
*Director of the United States Patent and Trademark Office*